US006079772A

United States Patent [19]

Green

[11] Patent Number: 6,079,772

[45] Date of Patent: Jun. 27, 2000

[54] SEAT

[75] Inventor: Elaine Green, Arkley, United Kingdom

[73] Assignee: Tamsit International Limited, London, United Kingdom

[21] Appl. No.: 09/077,810

[22] PCT Filed: Dec. 13, 1996

[86] PCT No.: PCT/GB96/03088

§ 371 Date: Jun. 11, 1998

§ 102(e) Date: Jun. 11, 1998

[87] PCT Pub. No.: WO97/23153

PCT Pub. Date: Jul. 3, 1997

[30] Foreign Application Priority Data

Dec. 22, 1995 [GB] United Kingdom ..... 9526373

[51] Int. Cl.[7] ..... A47C 4/00; A47D 1/02

[52] U.S. Cl. ..... 297/16.1; 297/17; 297/250.1; 297/256; 297/256.16; 297/440.12

[58] Field of Search ..... 297/16.1, 16.2, 297/17, 440.12, 440.1, 411.41, 250.1, 256.16, 256

[56] References Cited

U.S. PATENT DOCUMENTS

| | | | |
|---|---|---|---|
| 1,419,947 | 6/1922 | Schouten | 297/17 |
| 4,359,243 | 11/1982 | Crutcher | 297/16.1 |
| 4,854,638 | 8/1989 | Marcus et al. | 297/250.1 |
| 4,974,870 | 12/1990 | Jarke et al. | 297/17 X |
| 5,123,699 | 6/1992 | Warburton | 297/256 X |
| 5,609,389 | 3/1997 | Longoria et al. | 297/250.1 X |

FOREIGN PATENT DOCUMENTS

| | | |
|---|---|---|
| 0 369 693 | 5/1990 | European Pat. Off. . |
| 570 898 | 7/1945 | United Kingdom . |

*Primary Examiner*—Peter M. Cuomo
*Assistant Examiner*—Rodney B. White
*Attorney, Agent, or Firm*—King and Schickli, PLLC

[57] ABSTRACT

A collapsible seat, such as a booster seat, is disclosed. The booster seat 10 comprises a base 11, an upper U-shaped frame 12, a back wall 12, a front wall 14, a seat 15 and a pair of collapsible side walls 16. The back wall 13 is pivotally mounted at the rear of the frame 12 and locates on the base 11 at 19. The front of the seat 15 is pivotally engaged on the wall 16 in a manner which allows the seat to fold into a very compact shape.

4 Claims, 8 Drawing Sheets

SEAT

This invention relates to collapsible seats and in particular, but not exclusively, to seats which can be placed on existing chairs to elevate a small child to table level. Such seats are sometimes called booster seats.

These days restaurants make a much greater attempt to accommodate young children, but frequently there are insufficient highchairs, particularly if a number of small children are in the same party.

From one aspect the invention consists in a booster seat comprising a collapsible structure moveable between a collapsible "flat" configuration and an erected position and including a wall and a seat engaged on a wall for relative movement thereto between a position in which it is supported on or adjacent the upper edge of the wall in the erected position and a position in which its front edge is generally aligned with the lower edge of the wall.

Preferably, the seat further includes a base and in this case the wall is a front wall which is pivotally mounted on the base for movement between the flat position in which it lies on the base and an erected upright position.

The booster seat may include an upper frame and a back wall pivotally mounted on a flat upper frame for movement between a flat position in which it lies on the frame and an erected, upright, position in which it engages the base. The back wall may define a ledge to support the rear edge of the seat in the erected position.

The seat may further include foldable side walls interconnecting the base and the upper frame for folding, as the structure is moved into its flat position, to lie between the base and the upper frame.

Straps may be provided for attaching the booster seat to an existing chair and preferably there are straps which pass both under the seat of the chair and around its back. Additionally or alternatively, the seat may include straps for retaining a child in the seat.

The components of the seat may be made from a light rigid plastic material such as polypropylene and one or more of the components may include a carrying handle aperture, which is accessible when the seat is in its collapsed position.

Although the invention has been defined above, it is to be understood that it includes any inventive combination of the features set out above or in the following description.

The invention may be performed in various ways and a specific embodiment will now be described, by way of example, with reference to the accompanying drawings, in which.

Figure 1:
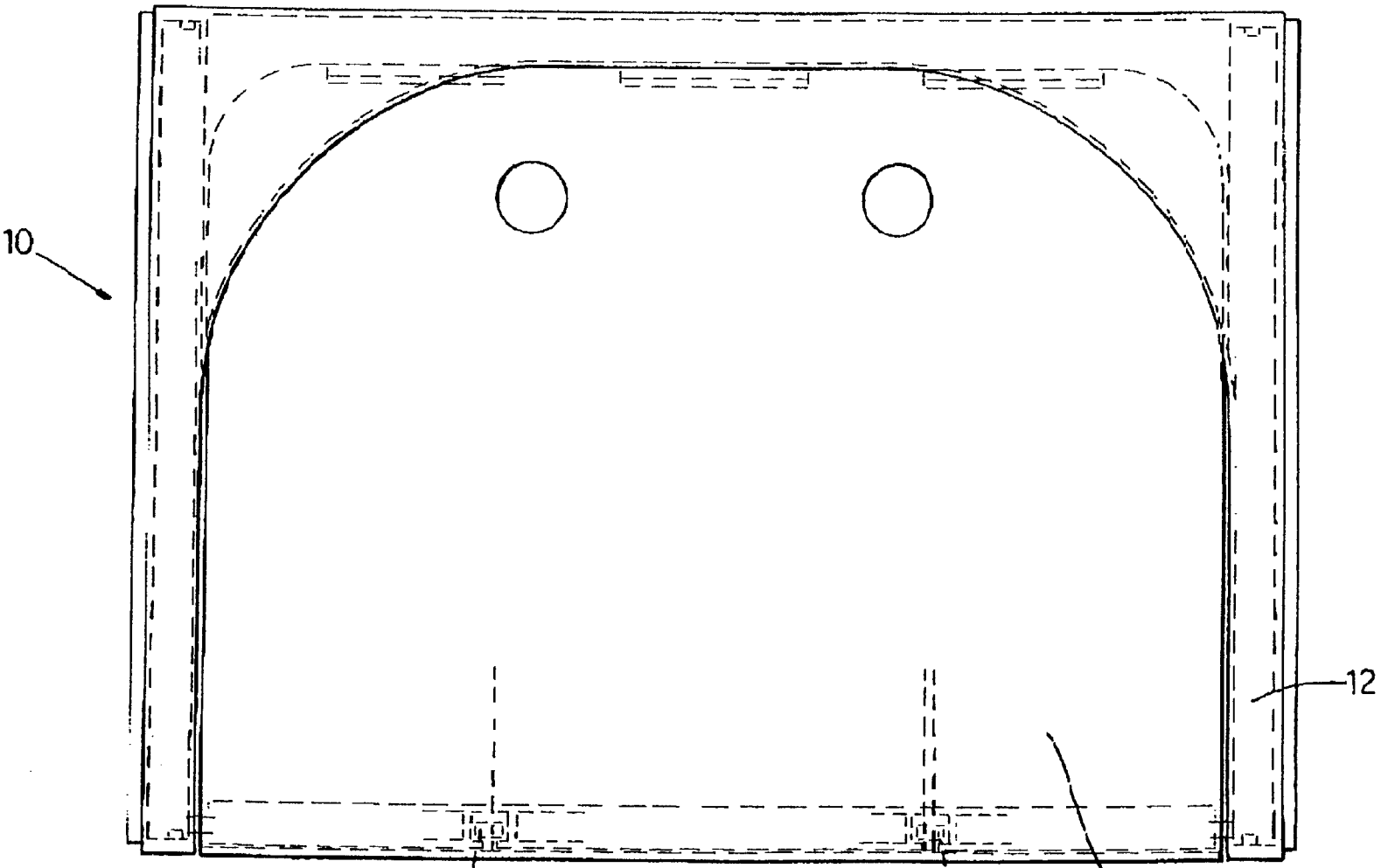
FIG. 1 is a view from above of a booster seat.

A booster seat generally indicated at 10, comprises a base 11, an upper U-shaped frame 12, a back wall 13, a front wall 14, a seat 15 and a pair of collapsible side walls 16.

Figure 2:
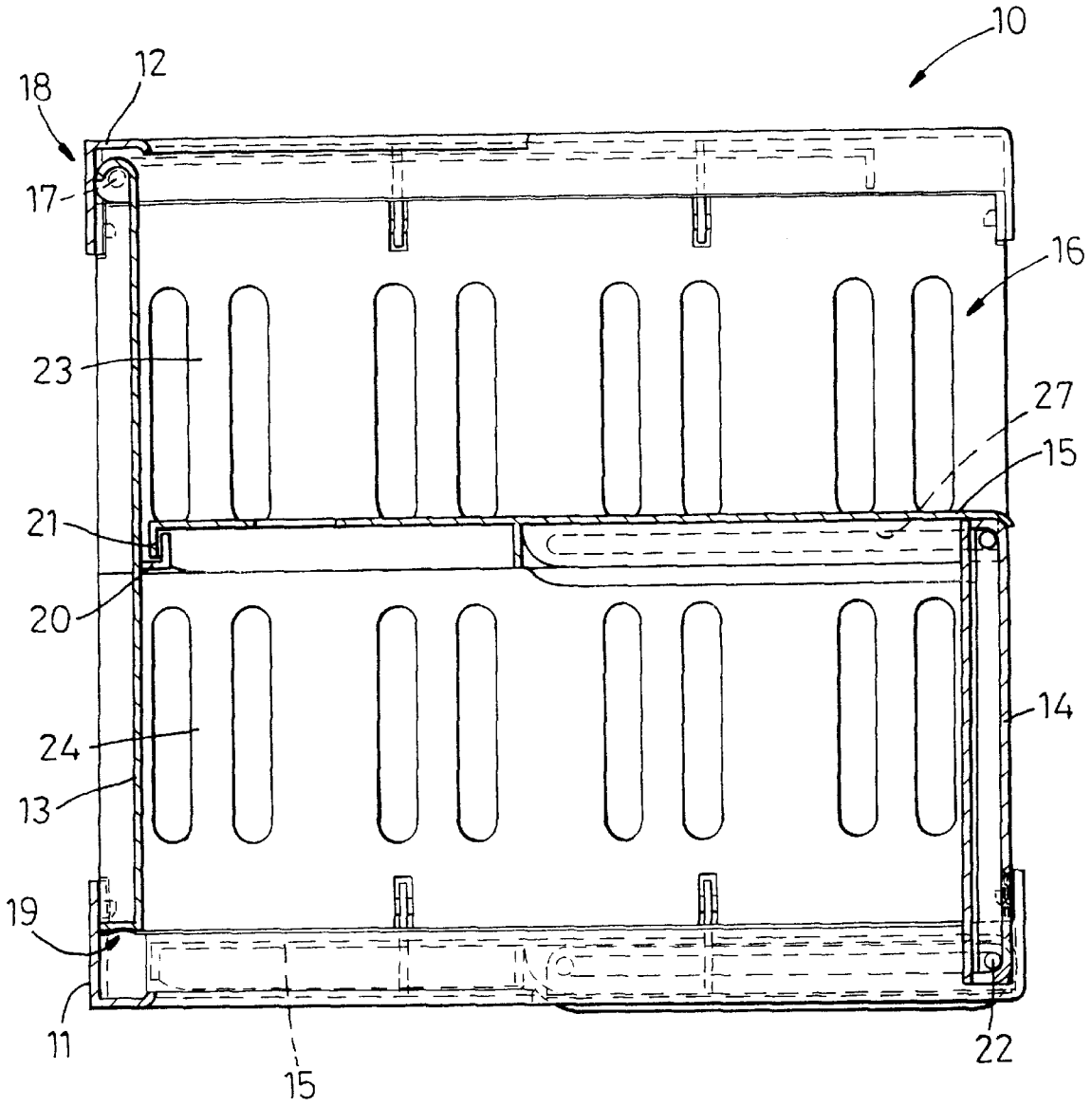
FIG. 2 is a vertical central section through the booster seat of FIG. 1.
Figure 3:
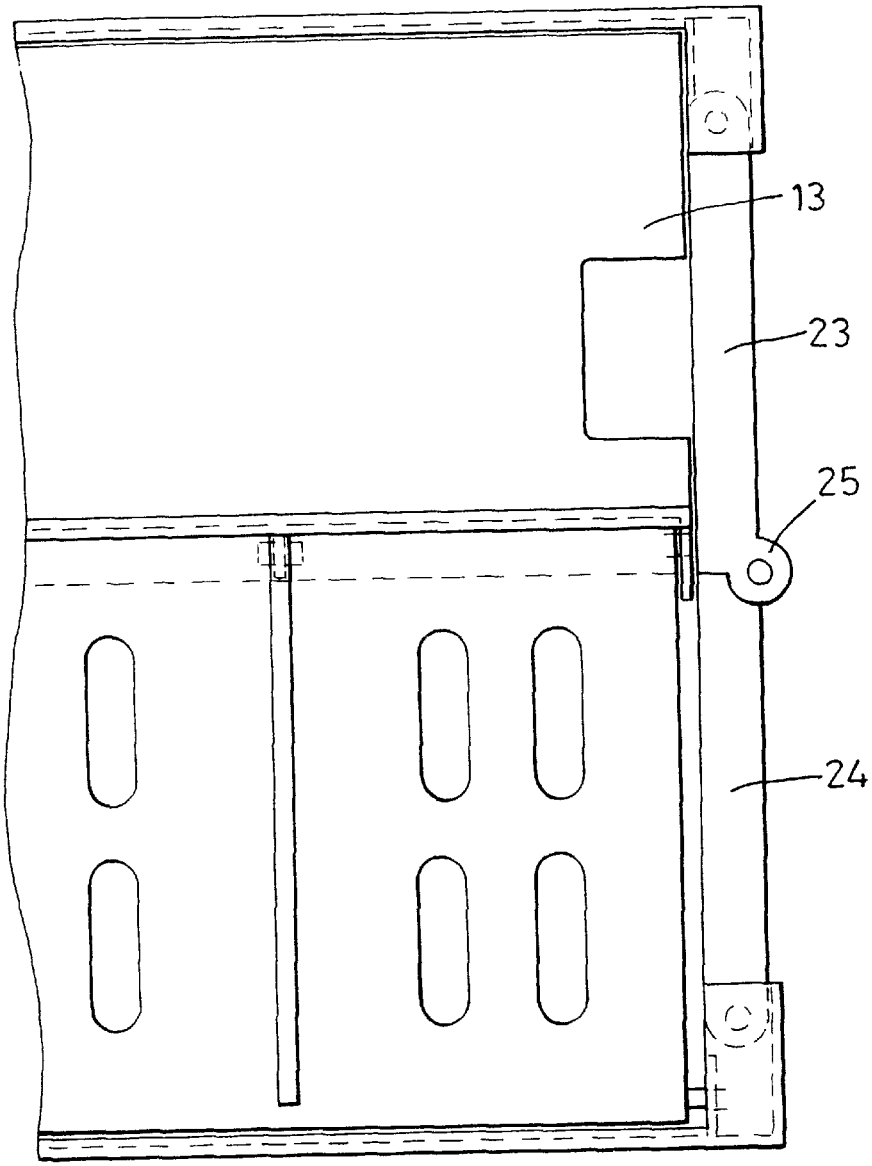
FIG. 3 is a view from the front of the right half of the booster seat.

The back wall 13 is pivotally mounted at 17 at the rear 18 of the upper frame 12 and frictionally locates at 19 on the base 11. The back wall 13 defines a ledge 20, which locates a flange 21 of the seat 15 to support it in the horizontal position shown in FIGS. 1 and 2. The front of the seat 15 is pivotally engaged on the front wall 14, in a manner which will be described below. The lower edge of the back wall 13 is pivotally mounted on the base 11 at 22.

Each side wall 16 comprises upper and lower portions 23, 24 which are hinged together by respective hinges 25. The upper wall portion 23 are hinged to the upper frame 12, whilst the lower wall portion 24 are hinged to the base 11.

Figure 4:
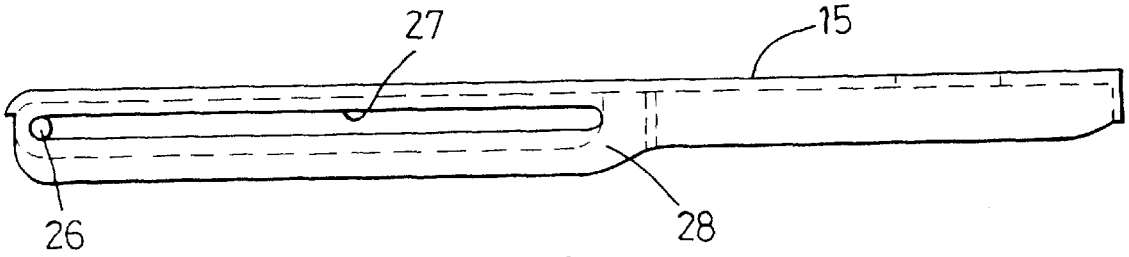
FIG. 4 is a side view of the seat of the booster seat of FIG. 1.
Figure 5:
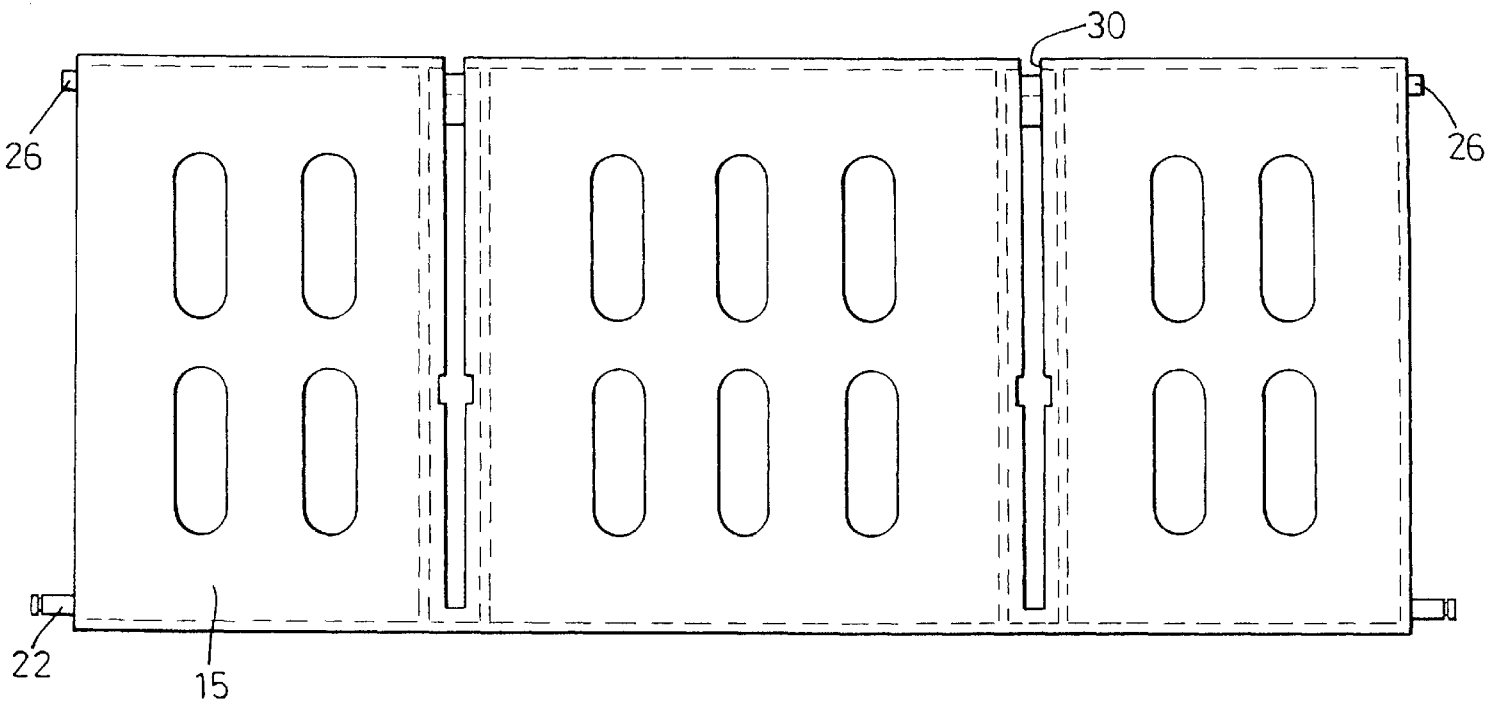
FIG. 5 is a view from the front of the front wall of he booster seat.
Figure 6:
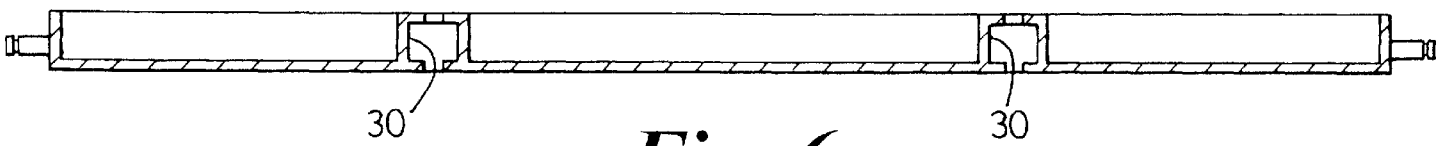
FIG. 6 is a horizontal section through the front wall of FIG. 5.
Figure 7:
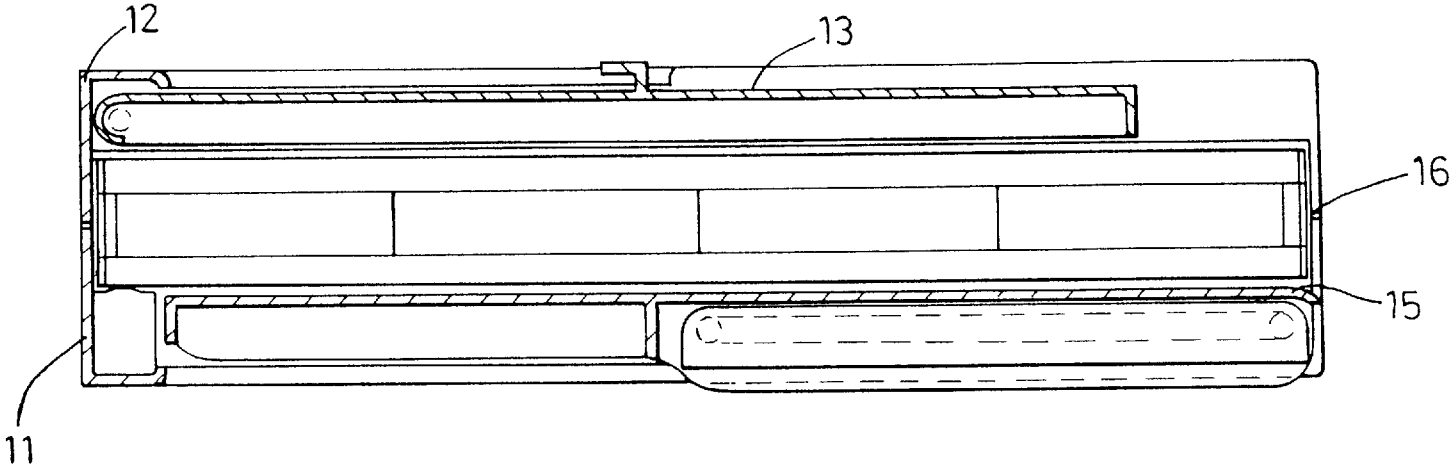
FIG. 7 is a corresponding section to FIG. 2, but with the seat in its collapsed position.
Figure 8:
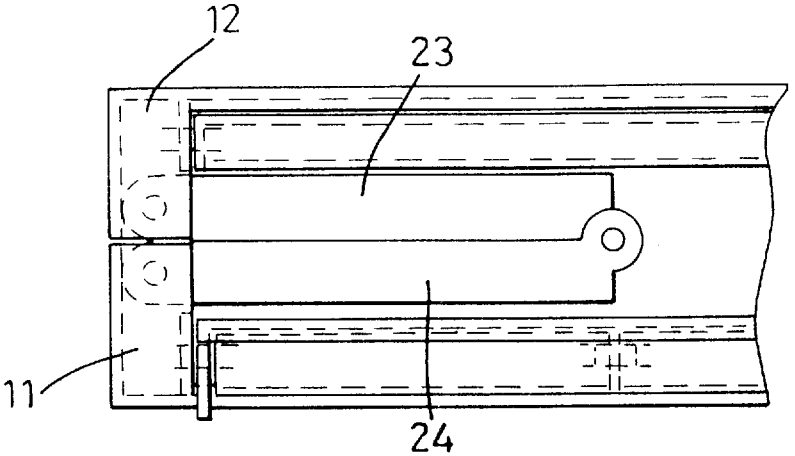
FIG. 8 is a corresponding view to that of FIG. 3 in the collapsed position.
Figure 10:
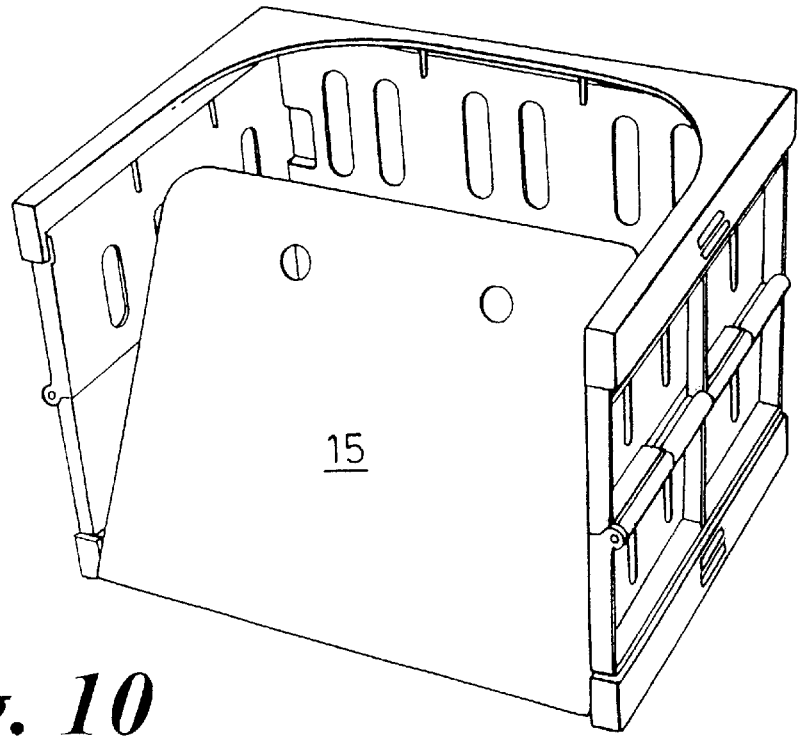
FIG. 10 is a corresponding view with the seat partially lowered.
Figure 11:
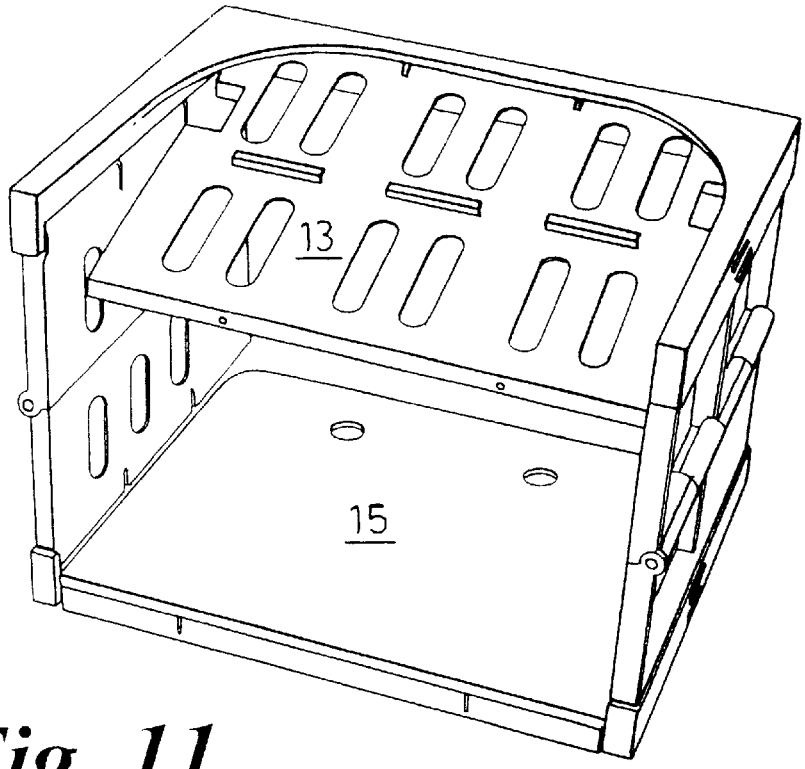
FIG. 11 shows the seat fully lowered and the back raised.

The front of the seat 15 is attached to the front wall 14 in two ways. Firstly, as can be seen in FIG. 5, the front wall 14 has upper lateral spigots 26 which locate in slots 27 formed in the side walls 28 of the seat 15. (This can be seen particularly in FIG. 4.) In addition, as is shown in chain line in FIG. 1, the seat 15 has pins 29 which engage in channels 30 formed vertically in the face of the front wall 14. This combination of locations enables the seat 15 to be disengaged from the back wall 13, and pivoted partly upwardly as the front wall begins to pivot downwardly towards the base 11. The seat can then be slid downwardly along the face of the front wall until its front edge is aligned with the bottom edge of the front wall. This position is shown in FIG. 10. The combination of the seat 15 and front wall 14 can then be finally pivoted into the flat position shown in FIG. 11.

Figure 9:
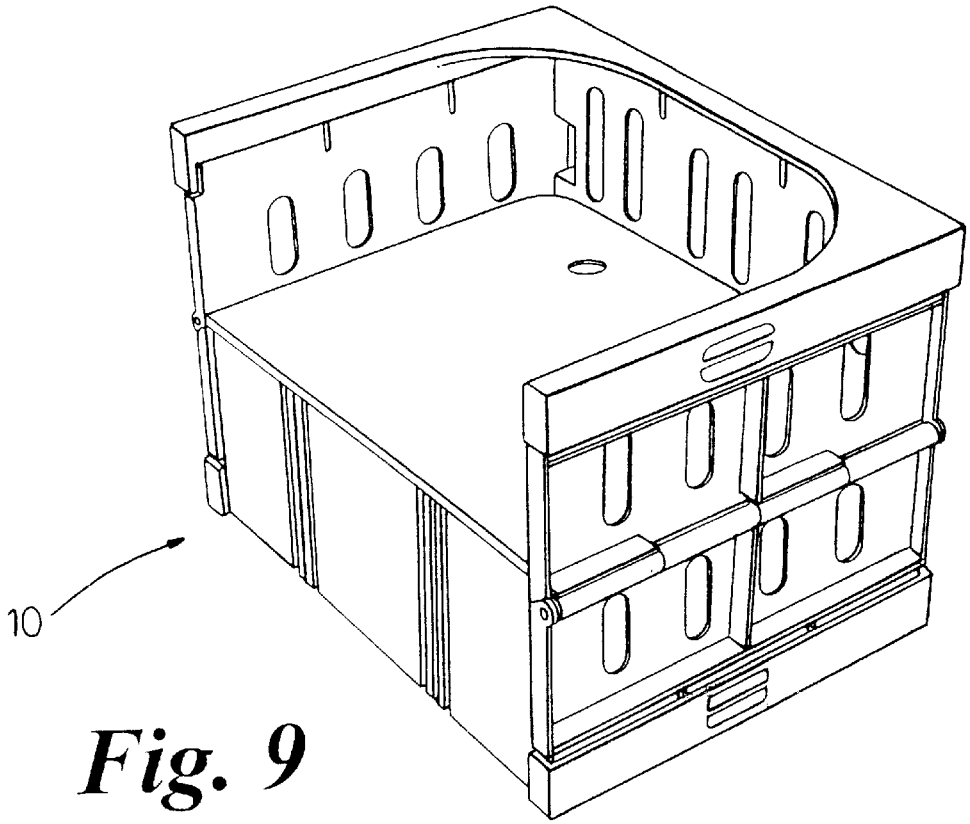
FIG. 9 is a view of the booster seat in its fully erected position.

It will be noticed that a number of cut outs are provided in the various elements of the booster seat 10 and these can be used for locating straps such as strap 32 shown in FIG. 9 both for attaching the seat to an existing chair and for retaining a child in the chair.

Figure 12:
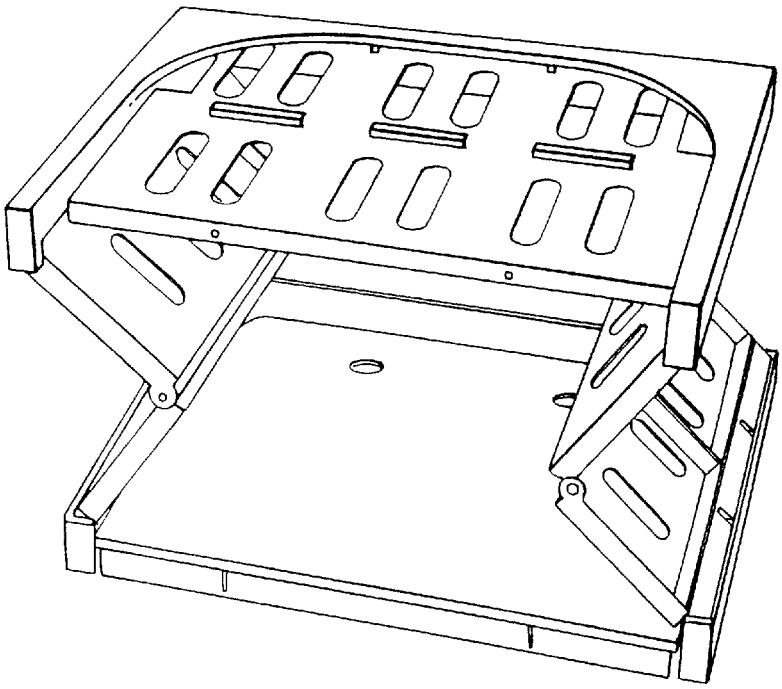
FIG. 12 shows the booster seat in a semi-collapsed position.
Figure 13:
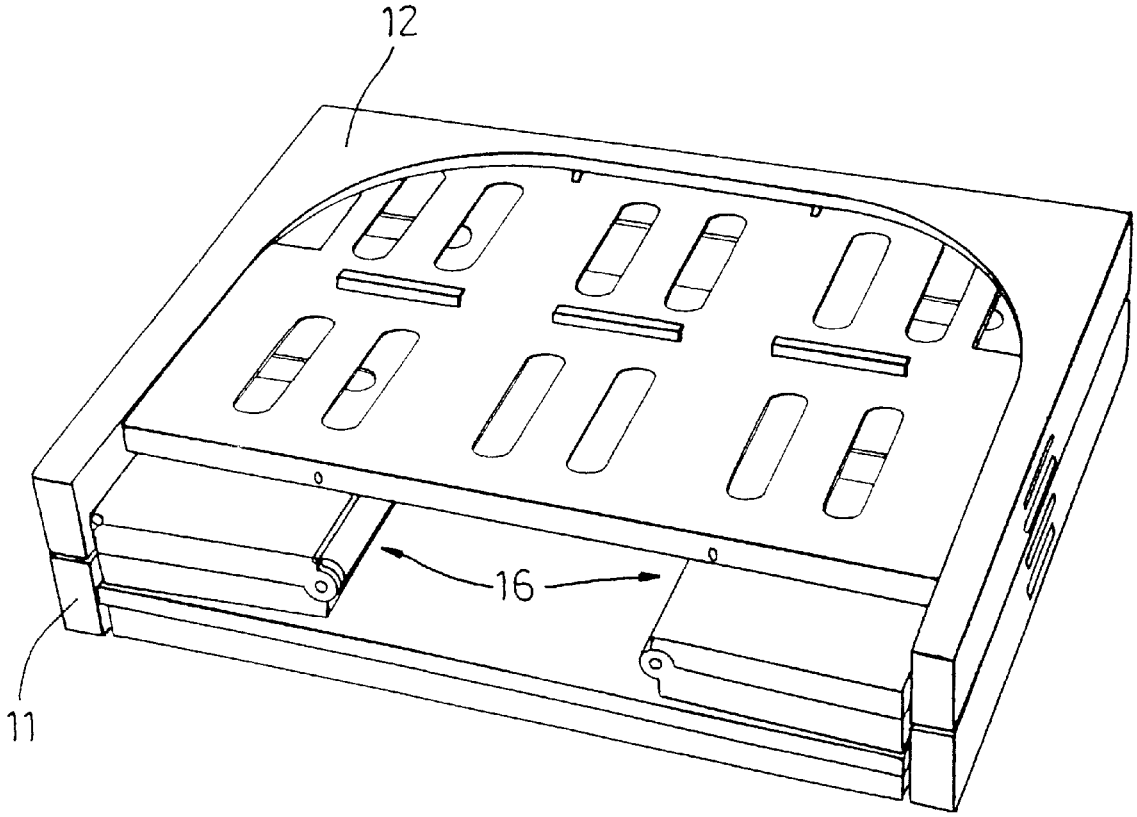
FIG. 13 shows the booster seat in a fully collapsed position.

Referring now to FIGS. 9 to 13, the booster seat 10 is shown in its fully erected position in FIG. 9. It can be collapsed into the arrangement shown in FIG. 13 as follows. As has already been described, the seat 15 can be disengaged from the back wall 13 and then moved to the FIG. 10 position and from there into the FIG. 11 position. The back wall can then be pivoted upwardly until it locates against the upper frame 12 where it can frictionally engage against a suitable bump or projection. The side walls 16 are then hinged inwardly, as is shown in FIG. 12, until the FIG. 13 position is reached.

It will be seen that by enabling the pivot axis of the seat 15 to move between a position in which it is aligned with the edge of the front wall 14 to a position in which it is aligned with the lower edge of the front wall 14, it is possible to have the seat 15 overlying the base in two alternate vertically spaced positions. This enables a extremely compact collapsed arrangement for the chair, whilst providing the maximum seat area for the minimum footprint.

The components may be made out of any suitable material, but a light-weight rigid plastics such as polypropylene is preferred. Such a material will not rust and can be wiped clean easily.

I claim:

1. A booster seat comprising a collapsible structure moveable between a collapsible flat configuration and an erected position and including a base, a front wall having upper and lower edges, said front wall pivotally mounted on the base for movement between a flat position in which the front wall lies on the base and an erected upright position, an upper frame, a backwall pivotally mounted on the upper frame for movement between a flat position in which the backwall lies on the upper frame and an erected, upright position in which the backwall engages the base, and a seat having a rear edge engaged on the backwall for relative movement between a position in which the seat is supported on or adjacent the upper edge of the backwall in the erected position and a position in which a front edge of the seat is generally aligned with the lower edge of the front wall, and wherein said backwall defines a ledge to support the rear edge of the seat in the erected position.

2. A booster seat as claimed in claim 1 including foldable side walls interconnecting the base and the upper frame for folding, as the seat moves into the flat position, to lie between the base and the upper frame.

3. A booster seat as claimed in claim 1 further including straps for attaching the seat to an existing chair.

4. A booster seat as claimed in claim 1 wherein at least a portion of the seat is made from a light rigid plastic material.

* * * * *